US006486453B1

(12) United States Patent
Bales et al.

(10) Patent No.: US 6,486,453 B1
(45) Date of Patent: Nov. 26, 2002

(54) MENU DRIVEN CONTROL SYSTEM FOR A COOKING APPLIANCE

(75) Inventors: Michael E. Bales, Cleveland, TN (US); John Scott Brown, Charleston, TN (US); Virginia L. Harwell, Cleveland, TN (US); Anthony E. Kendall, Ooletewah, TN (US); Susan K. Fisher, Ankeny, IA (US); Pamela S. Kleese, Des Moines, IA (US); Jill L. Means, Grundy Center, IA (US); Judith D. Barber, New Bern, NC (US); Philip R. McKee, Frisco, TX (US); James K. Pool, III, Richardson, TX (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/660,410

(22) Filed: Sep. 12, 2000

Related U.S. Application Data

(60) Provisional application No. 60/153,225, filed on Sep. 13, 1999.

(51) Int. Cl.[7] ..... H05B 6/68

(52) U.S. Cl. ..... 219/702; 219/681; 219/400; 219/718; 99/325

(58) Field of Search ..... 219/681, 682, 219/702, 720, 718, 506, 400; 99/325

(56) References Cited

U.S. PATENT DOCUMENTS

| | | | | |
|---|---|---|---|---|
| 5,349,164 A | | 9/1964 | Ohta | |
| 4,332,992 A | * | 6/1982 | Larsen et al. | 219/681 |
| 4,508,947 A | * | 4/1985 | Eka et al. | 219/681 |
| 4,517,431 A | * | 5/1985 | Ueda | 219/720 |
| 4,914,277 A | | 4/1990 | Guerin et al. | |
| 5,111,028 A | | 5/1992 | Lee | |
| 5,300,757 A | | 4/1994 | Hara et al. | |
| 5,317,130 A | | 5/1994 | Burkett et al. | |
| 5,321,232 A | | 6/1994 | Ogle | |
| 5,345,067 A | | 9/1994 | Ohta et al. | |
| 5,349,163 A | | 9/1994 | An | |
| 5,352,865 A | | 10/1994 | Burkett et al. | |
| 5,352,867 A | | 10/1994 | Shota | |
| 5,352,874 A | | 10/1994 | Gong | |
| 5,389,764 A | | 2/1995 | Nishii et al. | |
| 5,430,272 A | | 7/1995 | Takahashi | |
| 5,495,095 A | | 2/1996 | De Matteis et al. | |
| 5,528,018 A | | 6/1996 | Burkett et al. | |
| 5,539,671 A | | 7/1996 | Albrecht et al. | |
| 5,558,797 A | | 9/1996 | Takagi | |
| 5,620,624 A | | 4/1997 | Westerberg | |
| 5,662,025 A | | 9/1997 | Yoo | |
| 6,005,229 A | * | 12/1999 | Brown et al. | 219/506 |
| 6,060,701 A | * | 5/2000 | McKee et al. | 219/681 |
| 6,064,050 A | * | 5/2000 | Ishikawa et al. | 219/720 |
| 6,097,016 A | * | 8/2000 | Hirata et al. | 219/720 |
| 6,180,934 B1 | * | 1/2001 | Ishizaki et al. | 219/720 |

FOREIGN PATENT DOCUMENTS

| | | | | |
|---|---|---|---|---|
| JP | 58-117927 | * | 7/1983 | 219/720 |

* cited by examiner

*Primary Examiner*—Philip H. Leung
(74) *Attorney, Agent, or Firm*—Diederiks & Whitelaw, PLC

(57) ABSTRACT

A cooking appliance includes a controller which calculates a desired percentage of hot air convection and microwave energy needed to perform a cooking operation based on selections made by a user through a menu driven display. The display prompts a user for a programming inputs, while also displaying operational information to the user as needed. The programming options enable the user to select between various different cooking operations and also provides for appealing cooking sequences to be stored as cooking recipes. As needed, certain pre-cooking functions are automatically performed, such as heating or cooling of the oven cavity, as needed.

20 Claims, 6 Drawing Sheets

MENU DRIVEN CONTROL SYSTEM FOR A COOKING APPLIANCE

The present application claims priority on U.S. Provisional Application Ser. No. 60/153,225 filed Sep. 13, 1999.

BACKGROUND OF THE INVENTION

1. Field of the Invention

The present invention pertains to the art of cooking appliances and, more particularly, to a menu driven electronic interface system used in controlling the operation of a cooking appliance.

2. Discussion of the Prior Art

Cooking appliances have evolved in the fairly recent past to incorporate electronic controls. In fact, many ovens, ranges and the like available on the market today incorporate, to certain degrees, programmable features intended to aid a consumer in performing cooking operations. Actually, most electronic control systems for cooking appliances only enable a consumer to input certain cooking information, such as cooking modes, times and temperatures, with the inputted information generally being presented in a viewable display area and used to establish a cooking operation.

With the introduction of the microwave oven, additional electronic programming features became available. For instance, some microwave ovens available in the marketplace provide for the user input of a desired cooking or defrosting operation which can be carried out based on information concerning the category of food, e.g., meats, leftovers, canned goods, frozen dinners etc. When cooking meat in such known appliances, the approximate weight of the meat is also a common input parameter. With this information, the appliance performs a programmed cooking operation.

In any event, there have been developments in the art of cooking appliances directed to aiding a consumer in performing certain cooking operations effectively. However, there still exists a need for a more user friendly system for controlling the operation of a cooking appliance. More specifically, there exists a need for an electronic control system which functions to prompt a user, as needed, to input certain cooking information in a convenient and clear manner, and then automatically controls the cooking appliance to perform the desired operation. Furthermore, there is a need for an electronic cooking appliance control system which can itself be programmed to perform various operations in a desired manner, such as following a personal recipe stored in the system by the user.

SUMMARY OF THE INVENTION

The present invention pertains to a system for programming and operating a cooking appliance, preferably a cooking appliance which calculates a desired percentage of hot air convection and microwave energy need to perform a cooking operation in an efficient manner, based on selections made by a user. Most preferably, a menu driven display, such as a touch screen, is used to prompt a user for programming inputs, ranging from the type of cooking to be performed, relevant food groups, times, temperatures and the like. In addition to prompting the user for necessary programming information, the cooking appliance can pause the programming sequence to automatically perform preheating or cooling functions for the oven cavity as needed, preferably while displaying a control screen to the user concerning the function being performed.

Following the completion of a cooking operation performed based on the programming input by the user, the user can still provide for additional cooking to satisfy personal preferences. In addition, a favorite cooking sequence can be selectively saved as a recipe to be followed in subsequent cooking operations. Most preferably, the recipes are saved in an alpha format. In addition, pre-stored recipes can be executed as well.

Additional objects, features and advantages of the present invention will become more readily apparent from the following detailed description of a preferred embodiment thereof when taken in conjunction with the drawings wherein like reference numerals refer to corresponding parts in the several view.

DETAILED DESCRIPTION OF THE PREFERRED EMBODIMENT

Figure 1:
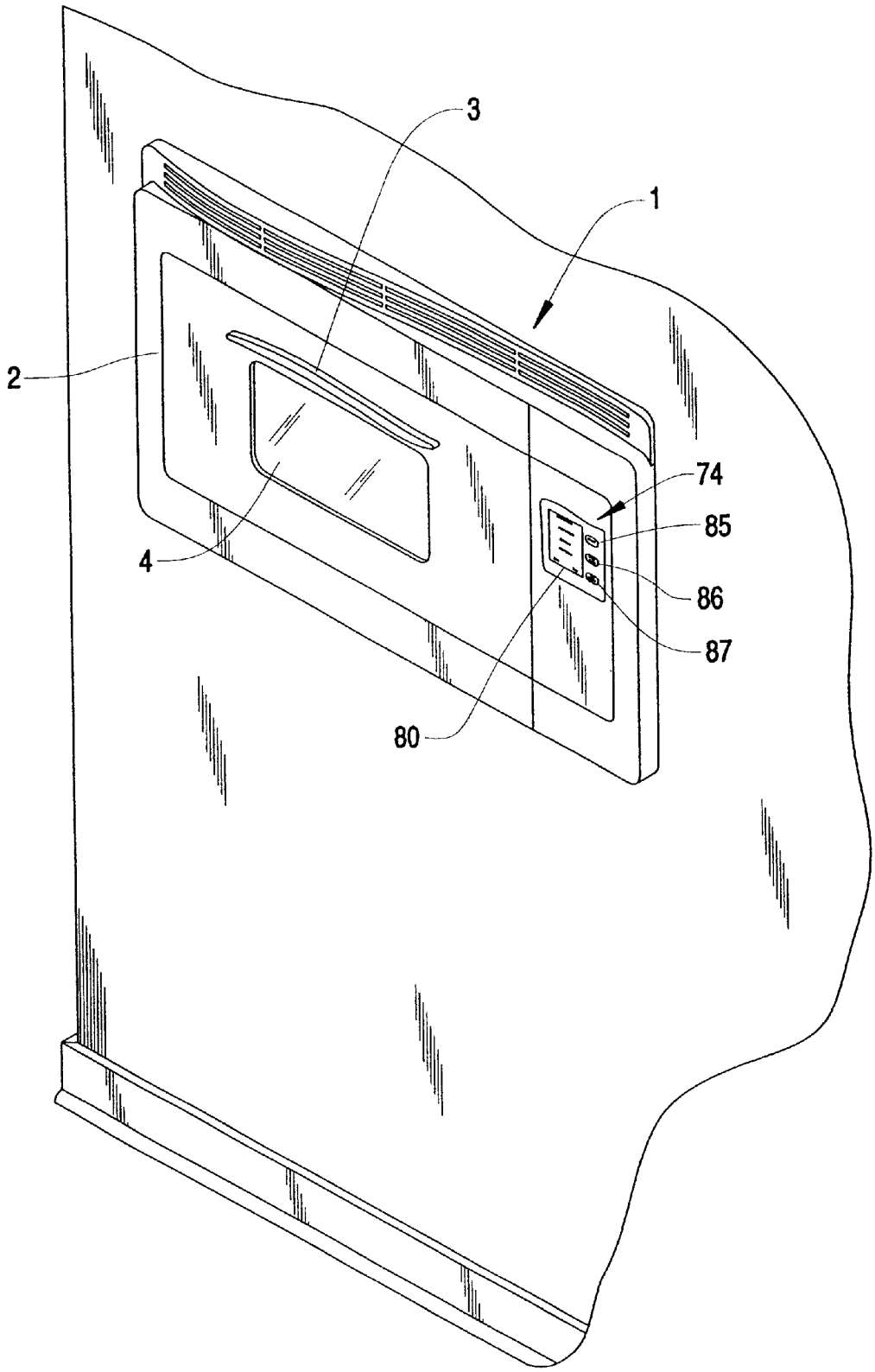
FIG. 1 is a perspective view of a wall mounted cooking appliance incorporating the menu driven control system of the invention.
Figure 2:
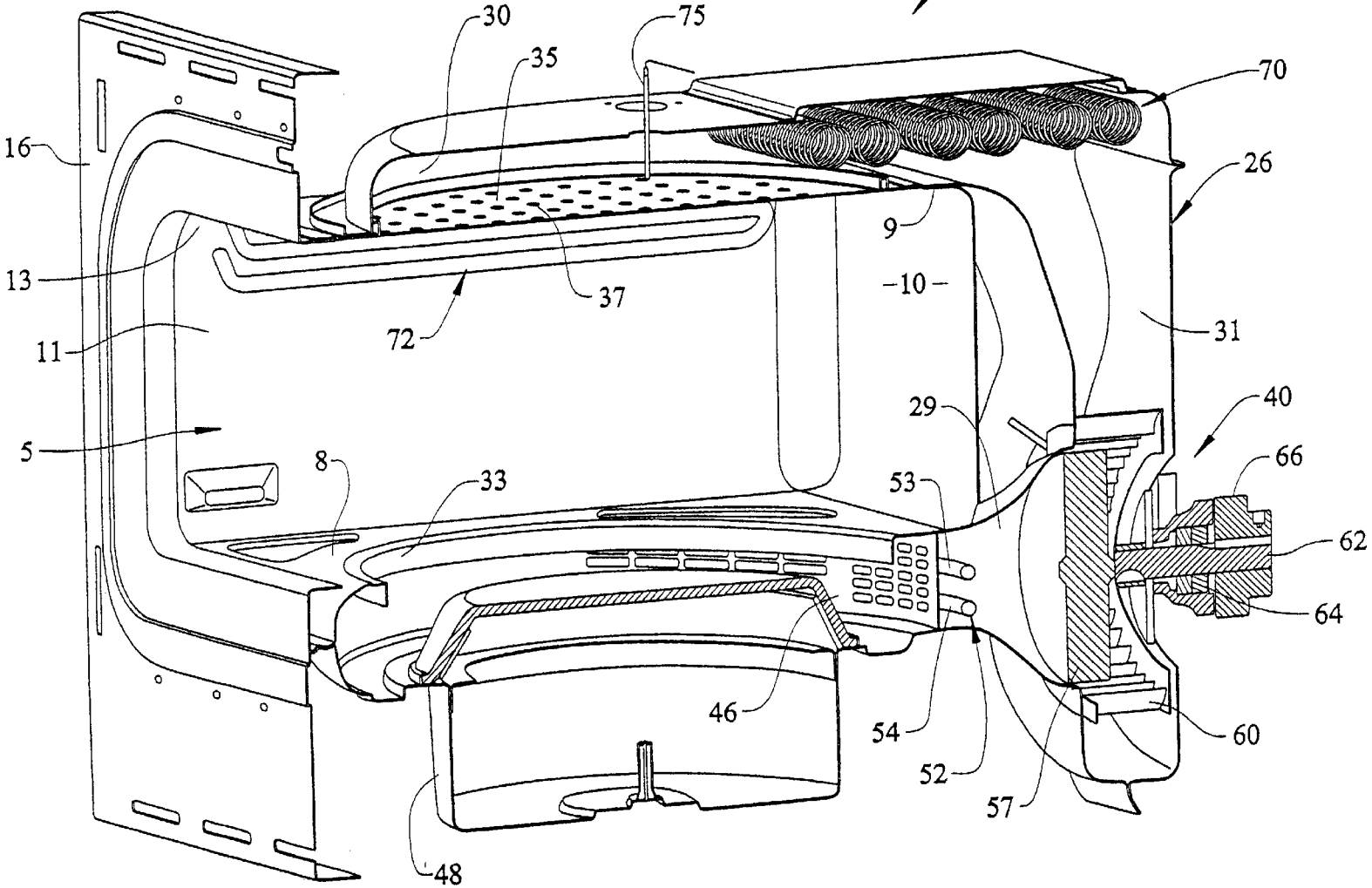
FIG. 2 is schematic side view of the internal structure of the cooking appliance of FIG. 1.
Figure 3:
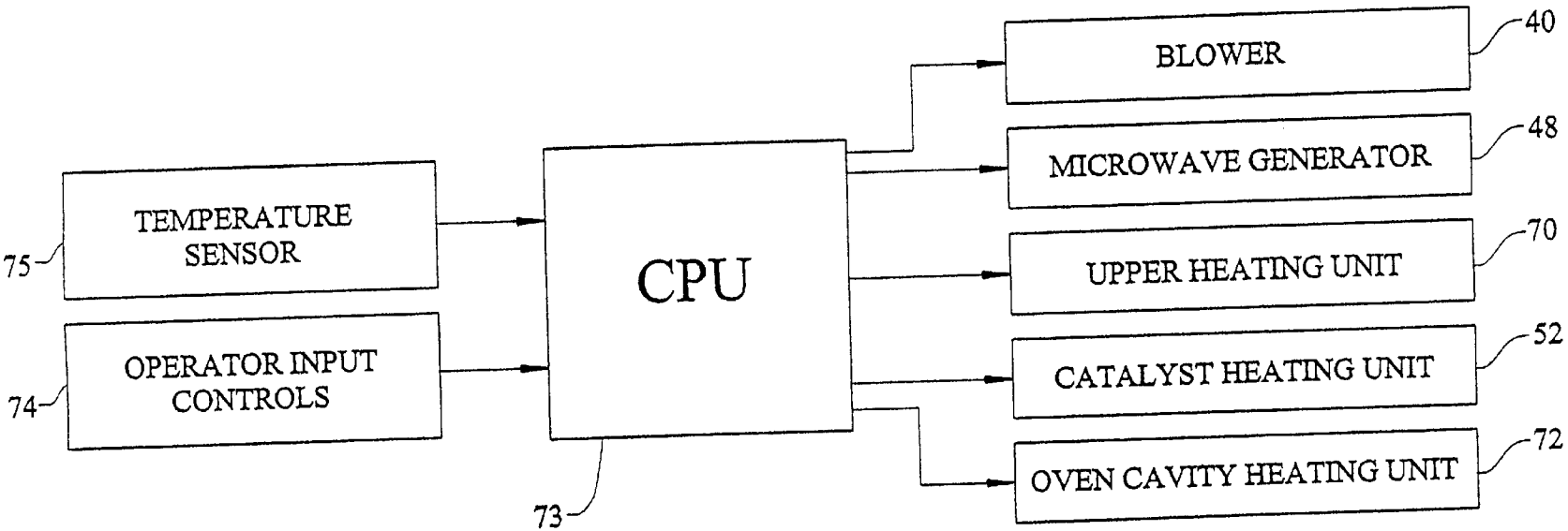
FIG. 3 is a block diagram of the control arrangement of the invention.

With initial reference to FIG. 1, a cooking appliance 1 is schematically shown in the form of a wall oven. Appliance 1 includes a door 2 having an associated handle 3 and window 4. Door 2 is adapted to be pivoted through handle 3 to expose oven cavity 5 as shown in FIG. 2. Oven cavity 5 generally defined by a bottom wall 8, a top wall 9, a rear wall 10 and a pair of side walls, one of which is indicated at 11. Oven cavity 5 also has associated therewith an access opening 13 for food items to be placed into or withdrawn from cavity 5. About access opening 13 is provided a frontal plate 16. In a manner known in the art, frontal plate 16 is adapted to be mounted against a substantially vertical wall such as in the kitchen of a residential home, and would have a door (not shown) pivotally attached thereto for selectively sealing off access opening 13.

Extending generally along bottom, top and rear walls 8–10 of cavity 5 is an air channel assembly 26 defined by ducting that leads into and out of cavity 5. More specifically, air channel assembly 26 includes a lower air return section 29, an upper air delivery section 30 and a rear air transfer section 31. Lower air return section 29 is open into cavity 5 through a substantially central return air outlet 33 formed in bottom 8. In the most preferred form of the invention, return air outlet 33 is constituted by a generally circular insert provided with various spaced holes (not shown). In a similar manner, upper air delivery section 30 includes a discharge or delivery inlet 35 formed in top wall 9. Although not shown in detail, inlet 35 is also preferably constituted by a generally circular-shaped insert which is attached to the remainder of upper air delivery section 30 and which is provided with a plurality of holes. As will become more fully evident below, the particular construction of cooking appliance 1 can significantly vary in accordance with the present invention. More specifically, it is only important in accordance with the present invention that cooking appliance 1 include an air channel assembly, such as that discussed above with reference to assembly 26, as well as a blower assembly, such as that generally indicated at 40, for use in generating a circulating flow of air through oven cavity 5. Although not considered a part of the present invention, a preferred construction for oven cavity 5 and air channel assembly 26 can be found in U.S. patent application entitled "OVEN CAVITY CONSTRUCTION" filed on Aug. 29, 2000 which is hereby incorporated by reference.

In the preferred embodiment shown, cooking appliance 1 constitutes an electric appliance and, more specifically, a combination convection, microwave and radiant cooking device. As shown in this Figure, cooking appliance 1 is provided with an annular filter basket 46, having a multitude of circumferentially spaced holes 47, which is positioned within lower air return section 29 and through which the air flowing from cavity 5 through return air outlet 33 is directed. Arranged below filter basket 46. is a microwave generator unit 48 incorporating a magnetron (not specifically shown). Encircling at least a portion of filter basket 46 is a first electric heating unit 52. Heating unit 52 is shown as constituted by a sheathed electric resistance heating element having upper and lower interconnected legs 53 and 54. First electric heating unit 52 is preferably provided to beat return air flowing from oven cavity 5, through outlet 33 and filter basket 56 prior to the air reaching a catalyst indicated at 57. In a manner known in the art, catalyst 57 functions to eliminate smoke and the like from the air stream. As shown, catalyst 57 extends partially within a rotatable blower element 60 which forms part of blower assembly 40. Although blower element 60 can take various forms while performing the desired air flow generating function, blower element 60 preferably constitutes a centrifugal unit arranged at the conjure of lower air return section 29 and rear air transfer section 31. In general, blower element 60 is secured to a rotatable shaft member 62. Shaft member 62 also has attached thereto, for non-relative rotation, a sheave 66 which is adapted to receive a belt (not shown) for use in rotating blower element 60 through shaft member 62 in combination with an electric motor (also not shown). As illustrated, sheave 66 is preferably arranged within a housing extension 68 which projects from rear air transfer section 31.

Preferably mounted in upper air delivery section 30 adjacent rear transfer section 31 is a second electric heating element arrangement 70 that is preferably constituted by a bank of heating coils. Although not pertinent to the present invention, second heating unit 70 can be defined by a single electric coil that runs back and forth across upper air delivery section 30 or multiple, separately controllable coil elements. In any event, second heating unit 70 functions to further heat the air flowing through channel assembly 26 prior to the air reaching discharge inlet 35. Also shown in this Figure is a third electric heating unit 72 which, in a manner similar to first electric heating unit 52, is preferably constituted by a sheathed, resistance-type heating element. Third electric heating unit 72 preferably extends adjacent top wall 9 and constitutes an additional heat source for cavity 5 of cooking appliance 1. The particular manner in which first, second and third electric heating units 52, 70 and 72 are utilized during operation of cooking appliance 1 for both cooking and cleaning modes of operation are not considered to constitute part of the present invention. Instead, these details can be found in pending U.S. patent applications entitled "HEATING SYSTEM FOR A COOKING APPLIANCE" and "SELF-CLEANING SYSTEM FOR A COOKING APPLIANCE", both of which are filed on Aug. 29, 2000, and incorporated by reference.

In general, each of blower assembly 40, microwave generator 48 and first, second and third electric heating units 52, 70 and 72 are linked to an appliance controller or CPU 73. Controller 73 also receives signals from operator input controls 74, as well as signals received from a temperature sensor 75 which is preferably arranged in upper air delivery section 30, between heating unit 70 and delivery inlet 35. The present invention is particularly directed to the manner in which cooking appliance 1 can be programmed and operated by prompting a user for specific information, recording the data and performing a cooking operation efficiently, and in an expedited manner as compare to conventional cooking devices, based on the information received and stored programming.

In the most preferred form of the invention, operator input controls 74 takes the form of a VFD display 80 (see FIG. 1), such as a 128×96 dot matrix, touch screen display, which enables an operator to readily review displayed data and select from that data to establish a desired cooking operation. The manner in which cooking appliance 1 operates in accordance with the most preferred embodiment will be described in detail below, particularly with reference to the block diagrams of FIGS. 4–6. However, it should be realized that, in addition to the control options presented in these figures, operator input controls 74 also preferably includes a "POWER" button 85, a "BACK/CLEAR" button 86 and a "TIME WIZARD" button 87 as best shown in FIG. 1. The POWER button 85 can simply be used to selectively turn on or off cooking appliance 1. BACK/CLEAR button 86 enables the user to erase an inadvertently inputted control parameter through display 80 by depressing button 86 once, or a series of inputted parameters by pressing button 86 multiple times or holding button 86 for a set period of time.

Figure 4:
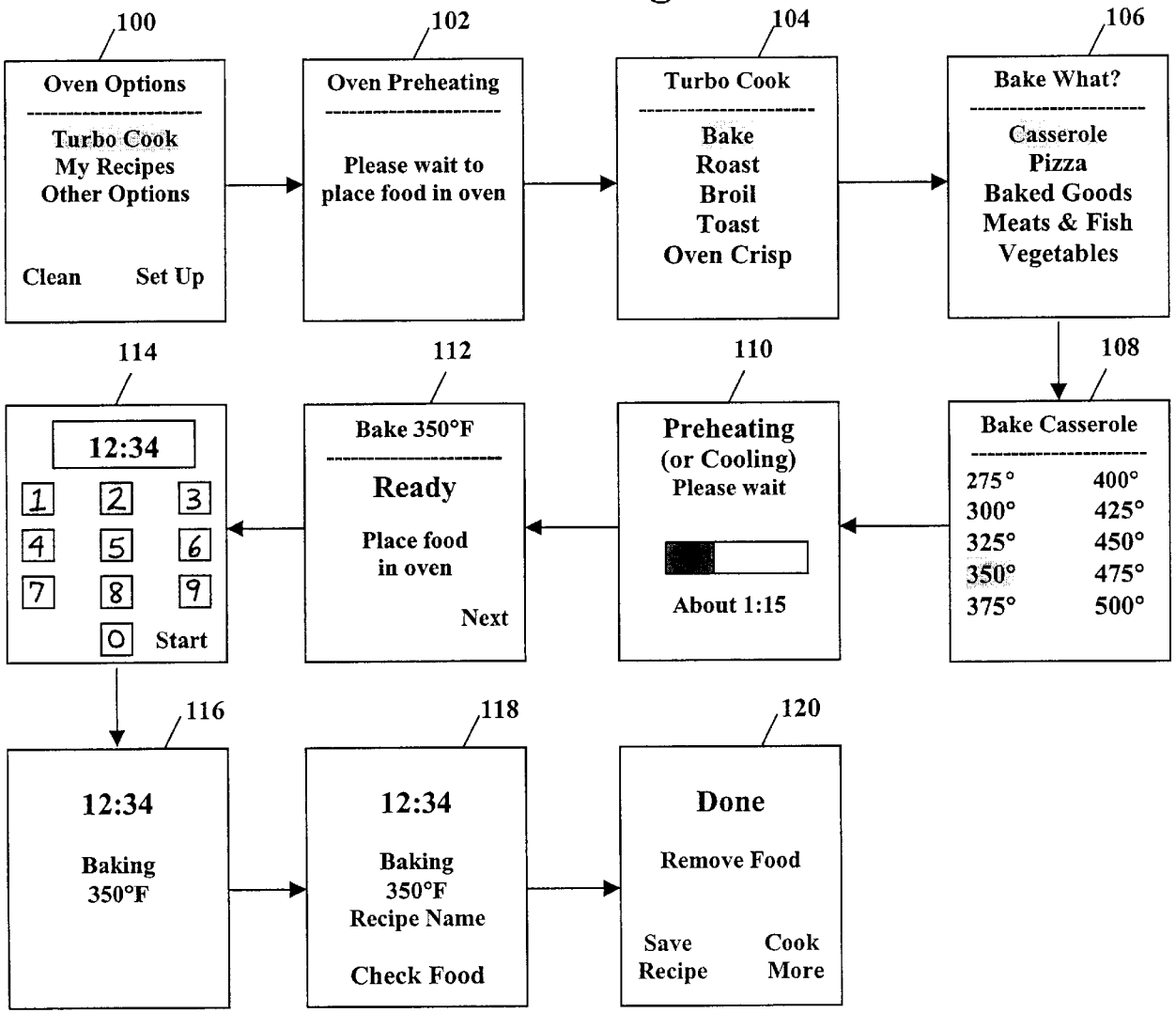
FIG. 4 is a block diagram illustrating a potential program sequence in accordance with the invention.

Reference will now be made to FIG. 4 in describing various, potential programming sequences in accordance with the invention. Upon activating cooking appliance 1 through power button 85, an initial screen 100 is preferably presented to user on display 80. As shown, screen 100 preferably presents various operating options for cooking appliance 1. With screen 100 being displayed, a user can select a desired operating command, preferably by simply touching a portion of the screen in which a keyword is indicated. As shown, the user can select "Turbo Cook", "My Recipes", "Other Options", "Clean" or "Set Up" options. Initially, it should be noted that the desired "Other Options" preferably include a standard baking function conducted within oven cavity 5, a microwave cooking mode or a defrost option. Further details of the operation of cooking appliance 1 upon selecting each of the options will be presented more fully below.

FIG. 4 particularly illustrates a preferred sequence when the user programs cooking appliance 1 under the "Turbo Cook" option. In general, this option enables the operation of cooking appliance 1 with hot air convection and microwave energies being utilized to cook food placed within oven cavity 5. Therefore, with general reference to FIG. 2, at least blower assembly 40, microwave generator unit 48 and heating unit 52 would be activated. Additionally, heating unit 70 can be activated depending upon the desired temperature needed. In general, controller 73 operates the hot air convection and microwave sources in pre-calculated percentages depending upon the type of food being cooked and the desired temperature as will become more fully evident below.

Referring back to FIG. 4, once the "Turbo Cook" option is selected, display 80 automatically shift to screen 102 wherein it is indicated to the user that the oven cavity 5 is being preheated. Here, there is a pause in the programmable inputs prompted for the user such as, for example, a couple of seconds to enable a flashing "preheating" message. In step or screen 104, the selected option is indicated at the top of the screen and various sub-options are presented. Here, cooking appliance 1 can be operated in any one of a selected bake, roast, broil, toast or oven crisp mode. For exemplary purposes, the bake option has been selected, whereupon display 80 prompts user to indicate what is specifically being baked at screen 106. For exemplary purposes, it is indicated that a casserole has been selected for cooking on screen 106 such that the user is then prompted to enter a desired cooking temperature at screen 108. Based on the selections made and the temperature reading given by sensor 75, controller 73 calculates the required amount of preheating time delay which is displayed to the user through screen 110. Therefore, there is again a pause before any further operations by the user are prompted.

In the most preferred embodiment, a visual indication of the amount of time prior to the operating program proceeding to the next step is indicated at screen 110. In the most preferred embodiment, both a decreasing horizontal bar graph and an actual countdown timing arrangement is presented to the user.

At this point, it should be noted that screen 110 is indicating that a preheating operating is being performed. FIG. 4 also indicates that this screen can convey to the user that a "Cooling" operation is being performed. That is, if a microwave operation is selected wherein blower assembly 40 would be deactivated, it may be necessary to cool down oven cavity 5 following a previous operation prior to performing a subsequent microwave operation. Therefore, depending upon the temperature within upper air delivery section 30 and the cooking mode selected, screen 110 can represent that either a preheating or cooling step is being performed. The next step would indicate to the user that it is time to place food in the oven as the desired temperature has been established within oven cavity 5. This is done through screen 112. At screen 114, the operator can introduce a desired operating time through a punch pad and then engage the "Start" button. Screen 116 would then display the time remaining in the selected operation in a countdown format, while also preferably displaying the particular option ("Turbo Cook") selected, as well as the selected temperature.

At some point in the operating sequence, preferably when about 80% of the cook time has been reached, CPU 73 will indicate to a user through display 80, as well as preferably through an audible indicator, that the food placed in oven cavity 5 should be checked. Although not shown, it is preferable to have a switch associated with door 2 which will send a message to controller 73 to indicate whether the user is actually checking on the food. In the most preferred embodiment, a certain time period, generally in the order of fifteen seconds to one minute, is accorded the user to open door 3 or else the cooking operation will proceed according to the original program. If door 3 is opened, screen 118 would change to an "Adjust Cook" selection screen (not shown) having sub-selections "Cook Less", "Cook and Brown Less", "Brown Less" and "Continue." As will also be discussed further, the "Cook Less" sub-option indicates that the food is internally done but that further external browning would be preferred. In the "Cook and Brown Less" sub-option, the food is internally and externally almost done. In the "Brown Less" option, the food would be indicated to be brown to a desired level, but still not internally done. In general, increasing browning would be performed without further activation of microwave generating unit 48 but rather through the use of the convection hot air cooking. Conversely, if the food is not internally done but is well browned, a higher percentage of microwave energy would be utilized. The "Continue" sub-option merely indicates that no adjustments are considered necessary and that the cooking can proceed to completion which, when reached, would be indicated at screen 120.

Once screen 120 is reached, additional options are available to the user. These options are perhaps best indicated with reference to FIG. 5. In one scenario, a user may be able to store a particular operating sequence for cooking appliance 1 which resulted in the food being cooked to an extremely desirable preference. In this case, the "Save Recipe" option can be selected through screen 120 which will result in screen 122 being displayed. Here, the cooking recipe can be stored in an alpha format, preferably up to about 18 characters. In order to save a desired recipe name, which could be either a coined term or simply a particular food group having been cooked to a certain likeness, the various letter buttons would be utilized. In the most preferred form of the invention, each letter location would be depressed once, twice or three times depending upon whether it is the first, second of third character which is desired. Therefore, if the letter "C" is to be selected, the "ABC" button would be pressed three times, followed by the enter button. Spaces can also be inserted, as well as the ampersand character as clearly shown. Once the desired characters are selected, the "Save" button could be engaged to save the recipe for future cooking. The manner in which recipes are recalled will be described fully below.

Figure 5:
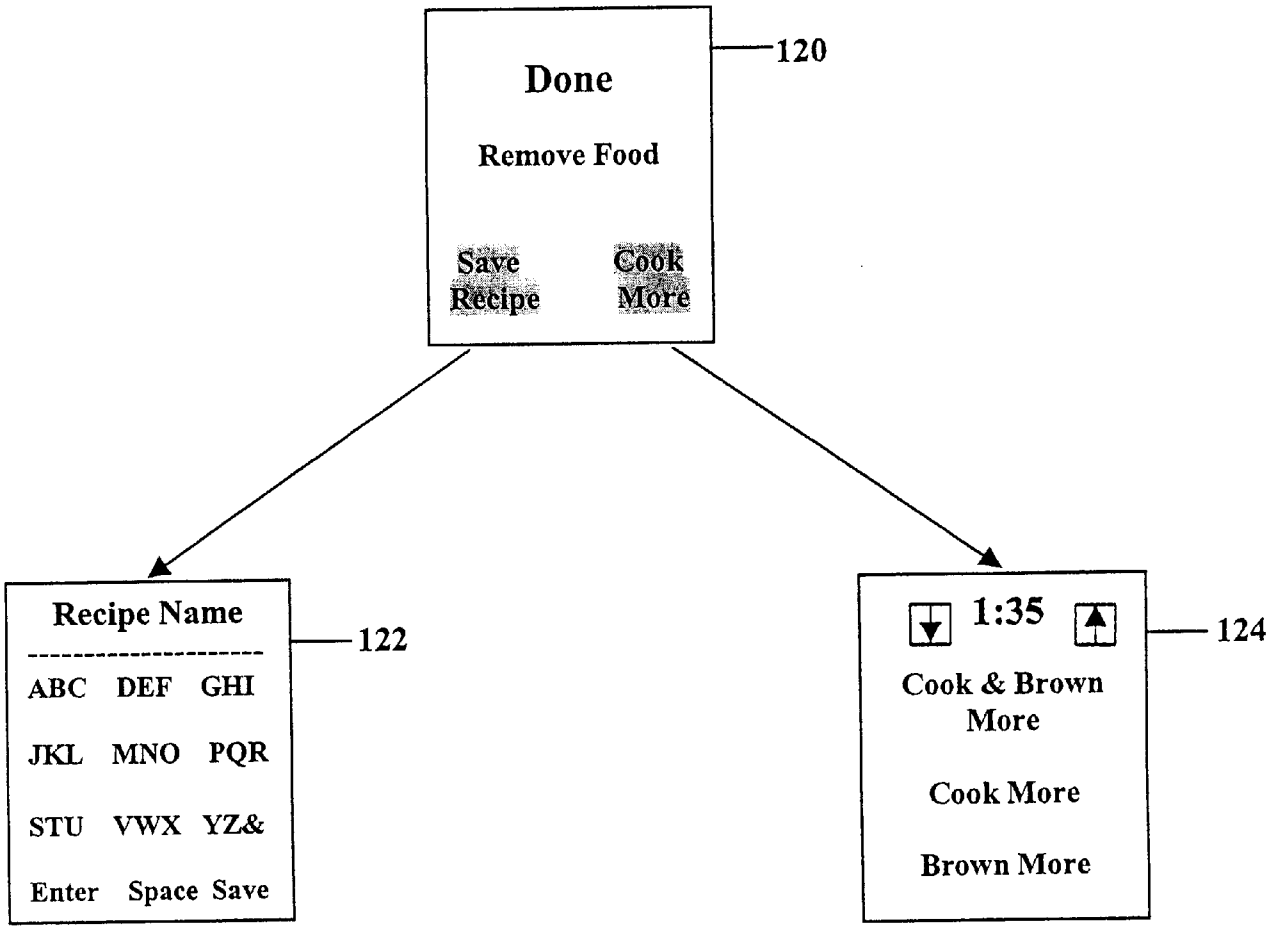
FIG. 5 is another block diagram illustrating additional, potential program sequences in accordance with the invention.

FIG. 5 also indicates that the user can select a "Cook More" operation through screen 120 to establish further cooking in order to fine tune or custom finish the final food preparation for desired texture and appearance. In the most preferred embodiment, the selections of "Cook and Brown More", "Cook More" and "Brown More" are available. When any of these selections are established, a time default of 20% of the original cook time will be presented and utilized as a pre-established subsequent cook time. However, the user can preferably increase or decrease this value through respective arrow keys (not labeled). Once the actual selection is made, a subsequent screen (not shown) will preferably indicate the time selected, as well as the cook mode selected, and will prompt the user to engage the start button. Thereafter, the screen will generally revert back to screen 116, while displaying the actual cooking operation selected in screen 124. Display 80 will then preferably skip screen 118 and go directly to screen 120, wherein the user will again have the option to save the recipe or provide even further cooking.

Figure 6:
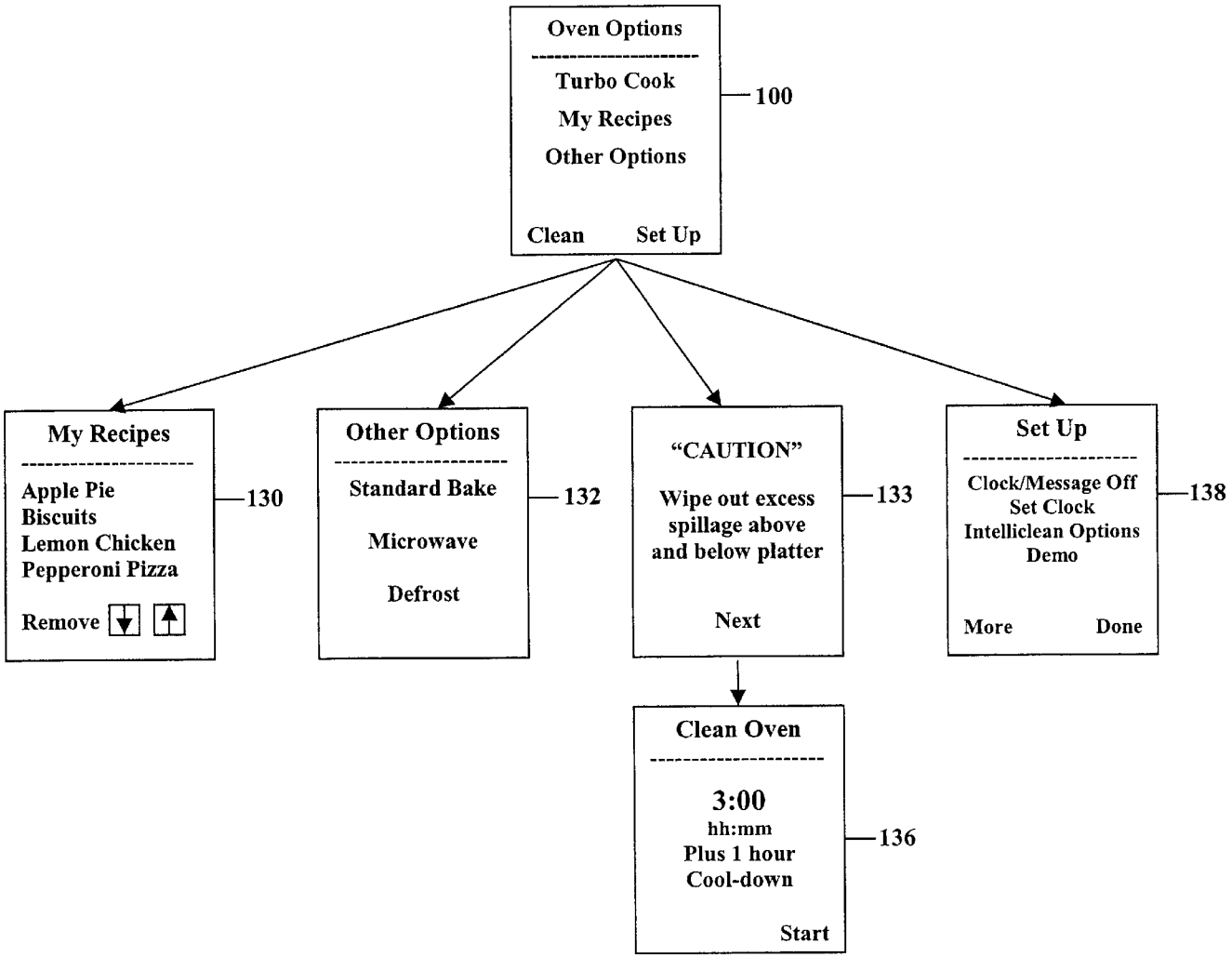
FIG. 6 is a further block diagram illustrating various other program sequences.

FIG. 6 indicates some additional programming sequences originating from original screen 100. That is, instead of selecting the "Turbo Cook" option, selecting the "My Recipes" option would result in screen 130 being presented to the user. The arrow keys would enable one to scroll up or down through a list of saved recipes. Simply touching the alpha characters for the desired recipe would start the preheating (or cooling) of oven cavity 5. Therefore, the control sequence of FIG. 4 would automatically skip to step 110 and then to step 112. Furthermore, in this programming sequence, screen 114 would be skipped such that, upon displaying of screen 112 and the user opening and closing of door 3, screen 116 would appear, except that the selected recipe name would also be presented in a manner corresponding to that of screen 118. If desired, arrow keys could also be presented for use in adjusting a time.

As shown in FIG. 6, screen 130 would also enable removal of a stored recipe by simply selecting the "Remove" option, scrolling up and down to find the desired recipe, and then touching the recipe. Most preferably, a subsequent screen would display the recipe and ask for verification that the recipe should be removed with indications of "Yes" or "No". In the most preferred embodiment, the stored recipe recalls the original recipe set up only. That is, if any "Cook More" or custom finish alterations are made, these would normally not be considered part of the desired main recipe. However, it should be readily apparent that the additional times added for the supplemental cooking operation could be readily added and stored in the preferred recipes through a simple programming change if desired.

FIG. 6 lists the other options available for cooking appliance 1 that are not specifically shown on screen 100. That is, as already discussed above with respect to FIG. 4, an additional standard bake, microwave or defrost option would be available. In the standard bake option, microwave generator 48 is not activated. In the microwave cooking option, blower assembly 40 is deactivated and microwave generator 48 is activated, preferably along with heating unit 52. The defrost mode is preferably carried out with a combination of hot air convection and microwave energy, but at reduced power levels.

More specifically, selecting the "Standard Bake" option would result in a screen analogous to 108 wherein a user would have to select a desired baking temperature. Thereafter, a screen corresponding to 110 would be presented, followed by screens corresponding to 112, 114, 116, 118 and 120. In the microwave operating format, a cooling operation would be displayed at screen 110 if a previous oven option were used and oven cavity 5 was determined to be too hot based on signals from sensor 75. If microwave safe cookware, such as glass or ceramic were being utilized, this option could be skipped and screen 110 can be provided with a "Continue" option for this purpose. Otherwise, programming sequence will wait until oven cavity 5 has cooled before proceeding. Thereafter, a screen corresponding to 114 will be displayed, with a further key option of adjusting the power level being presented opposite the "Start" button and below the number "7" button. If the "Power Level" button was not selected, controller 73 would be move directly to the cooking operation. Otherwise, an additional display screen (not shown) would not be presented which would preferably take a format, similar to screen 114, while indicating power level selections of 10% –90% at 10 degree increments, as well as a "High" selection. Finally, for the defrost option, the most preferred embodiment follows this selection with a screen relating to the particular food category being defrosted, such as "Beef", "Pork", "Poultry", "Fish" or "Other" selection, followed by a screen wherein the weight of the meat is entered in a manner analogous to a known type of defrost operation in a conventional microwave. Finally, the time to defrost would be entered through the use of a screen corresponding to screen 114.

If the "Clean" option is selected at screen 100, screen 134 is displayed to the user. Here, the user should remove any cooking utensils from oven cavity 5 and wipe any excess soils. After this has been completed, the "Next" button would be depressed and display 80 would shift to screen 136. Here, a message would be used to show a default cleaning time plus a cool down time. If desired, up and down arrows can be presented to enable the user to either increase or decrease the cleaning time if it is felt that the oven cavity was either heavy or lightly soiled. Thereafter, the "Start" button would be selected. Preferably, oven door 3 has associated therewith a lock (not shown) which would maintain the oven locked until after the cool down time has elapsed. Thereafter, an additional screen (not shown) would be presented to indicate to the user that the cleaning operation is complete and to display a message asking the user to wipe out the oven interior. Following this, the display 80 would revert back to the main menu of screen 100.

Finally, FIG. 6 indicates a possibility of entering a "Set Up" mode which will result in screen 138 being displayed. Preferably, cooking appliance 1 can be programmed to present and adjust a clock setting and to enable a user to go through a demo mode which generally indicates the technological features and benefits associated with the overall menu driven controller system of the invention. Further, as shown, an "Intelliclean" option can be selected. This option could be used to automatically display to the user when a cleaning operation should be performed. It is actually desirable in accordance with the most preferred embodiment of the invention to have the user actually select whether this control option is even performed and also the basis upon which the option is run. That is, the user can select from various options, such as having a cleaning prompt displayed after the cooking appliance 1 has been utilized a predetermined number of times, such as after 5, 10 or 15 cooking operations; to clean after a certain number of minutes, such as 60, 90 or 120; or even to prompt for a cleaning based on the number of opening and closing of door 3. Therefore, it should be noted that signals can be sent to controller 73 indicative of the number of uses or minutes of cook time associated with oven cavity 5 and display 80 can be used to let the user know when cooking appliance 1 should be cleaned.

It is recognized that, given the unique nature of the cooking sequences which can be performed in accordance with the invention under the "Turbo Cook" option through screen 100, that entering cook times at screen 114 may be, at least initially, questioned by a user. Therefore, in accordance with the most preferred embodiment of the invention, it is desired to incorporate the "Time Wizard" button 87 which can be used, in combination with additional information presented by the user, to calculate the necessary cook time in this mode based on the temperature and food category that have been entered by the user. In general, this function operates to ask a series of questions, such as the weight of the food, thickness and/or the desired degree of doneness, to calculate the cooking time. Most preferably, this option can only be activated when it is time to enter the cook time at step 114. Therefore, this option would prompt the user to enter the weight, followed by the degree of doneness such as "Medium", "Medium Rare", etc. and then will jump right to the recommended cook time as basically shown in screen 116. Most preferably, the user can scroll through various options to establish a basis for the cook time. That is, instead of the weight being entered, the thickness of a piece of meat, fish or the like to be cooked could be utilized as the basis for establishing the desired cook time. In general, controller 73 stores, such as in a chart format, various cook times and source percentages related to these parameters based on testing. Once a cooking operation is performed in this manner, the user will still have the ability to save the cooking operation as a recipe at screen 120 in the manner discussed above.

Based on the above, it should be readily apparent that the menu driven controller system of the present invention provides an enhanced system for receiving operating instructions from a user, while also enabling specific commands to be automatically directed to cooking appliance 1. Furthermore, based on the input information, controller 73 functions to operate one or more of the various energy sources associated with cooking appliance 1 as described above in order to optimize the quality of the cooking operation, while also achieving this quality operation in a minimal amount of time. In general, it has been found that cooking appliance 1 can perform a wide range of cooking functions in the order to five times as fast as a conventional oven without compromising on taste, texture and/or appearance of the food being prepared. That is, an optimal percentage of the microwave energy, as well as the convection heating energy with the heated forced air impinging on the food, provides for these optimal results. However, although described with respect to a preferred embodiment, it should be readily apparent that various changes and/or modifications can be made to the invention without departing from the spirit thereof. For instance, although a touch screen control arrangement has been described, it would be possible to use a roller ball, arrow pointer similar to that available in various notebook-style computers and other types of control screen arrangements known in the art and could be employed for this purpose. Therefore, in general, the invention is only intended to be limited by the scope of the following claims.

We claim:

1. A method of controlling a combination microwave and convection cooking appliance comprising:

receiving an initial programming input for the appliance from the user through a control panel;

prompting a user for additional input; and performing a cooking operation in an oven cavity of the cooking appliance, utilizing a calculated percentage of hot air convection and microwave energy.

2. The method according to claim 1, further comprising: automatically establishing a pre-cooking temperature for the oven cavity following the initial programming input.

3. The method according to claim 2, wherein the pre-cooking temperature is established by reducing a temperature in the oven cavity prior to performing the cooking operation.

4. The method according to claim 2, wherein the oven cavity is pre-heated prior to prompting the user for additional programming input.

5. The method according to claim 1, further comprising:

recalling a recipe stored in a memory of the cooking appliance; and performing the cooking operation based on operating instructions from the recipe.

6. The method according to claim 1, further comprising: selectively storing the cooking operation as a preferred recipe which can be later selected to establish a predetermined operating instructions for the cooking appliance.

7. The method according to claim 6, further comprising: storing the cooking operation under an alpha format selected and programmed by the user.

8. The method according to claim 1, further comprising: prompting the user for a supplemental control input for further cooking instructions following the cooking operation.

9. The method according to claim 8, wherein the supplemental control input alters the calculated percentage.

10. The method according to claim 1, wherein programming inputs from the user are received through a touch screen.

11. A method of controlling a cooking appliance comprising:

presenting a user with a sequence of programming screens for inputting operating selections through screens, following an initial screen displaying user selections which are dependent on a prior operating selection made by the user; and introducing at least one control display screen between a sequential set of the programming screens, said control display screen pausing the sequence of programming screens to display operational information to the user concerning an automatic pre-cooking operation being performed by the cooking appliance.

12. The method according to claim 11, further comprising: receiving operating selections from the user through a touch screen.

13. The method according to claim 11, wherein the initial screen display enables an operating selection of an established recipe of the user.

14. The method according to claim 11, wherein the initial screen display enables an operating selection establishing a cooking operation including a calculated percentage of hot air convection and microwave energy.

15. The method according to claim 14, further comprising: prompting the user for a supplemental control input for further cooking instructions following the cooking operation.

16. The method according to claim 15, wherein the supplemental control input alters the calculated percentage.

17. In a cooking appliance including an oven cavity adapted to be used in cooking foods with hot air convection and microwave energy, a menu driven control system comprising:

a display device for presenting available programming options to a user, with selected programming options of the user being adapted to be made through the display device; and a controller for establishing a cooking operation within the oven cavity utilizing a calculated percentage of hot air convection and microwave energy based on the selected programming options.

18. The menu driven control system according to claim 17, wherein the display device comprises a touch screen.

19. The menu driven control system according to claim 17, further comprising: memory means for storing desired recipes, said display device presenting the recipes for selection to the user in an alpha format.

20. The menu driven control system according to claim 17, further comprising: a power button for the display device.

* * * * *